United States Patent [19]

Davis

[11] 4,276,531

[45] Jun. 30, 1981

[54] NONRESETTABLE THERMALLY ACTUATED SWITCH

[76] Inventor: Merwyn C. Davis, 316 W. Battaglia Rd., Arizona City, Ariz. 85223

[21] Appl. No.: 32,006

[22] Filed: Apr. 20, 1979

[51] Int. Cl.[3] ..... H01H 37/76

[52] U.S. Cl. ..... 337/407; 337/408

[58] Field of Search ..... 337/407, 408, 409

[56] References Cited

U.S. PATENT DOCUMENTS

| | | | |
|---|---|---|---|
| 3,944,960 | 3/1976 | Audette et al. | 337/408 |
| 4,109,229 | 8/1978 | Plasko | 337/408 |
| 4,167,724 | 9/1979 | McCaughna | 337/407 |
| 4,184,139 | 1/1980 | Hara | 337/407 |

*Primary Examiner*—Harold Broome

*Attorney, Agent, or Firm*—Gregory J. Nelson

[57] ABSTRACT

A thermal limiter construction having a generally cylindrical housing or casing provided with an oppositely extending pair of conductor leads, one of which is insulated from the casing and the other is conductive with the casing. In the closed position, a contact engages the end of the conductor which insulated with the case. The contact has a flange member engaging the inner wall of the casing. A trip spring extends between the contact and the insulated casing end. A fusable pellet is provided in the lower end of the casing. An elastomeric member is interposed between the pellet and a contact surface and when deformed radially urges the contact flange members into tight engagement with the interior casing walls in the closed position. Upon collapse of the pellet when a pre-determined temperature is reached, the elastomeric member is allowed to return to a non-deformed condition permitting the trip spring to move the contact out of engagement with the end of the conductor interrupting conductivity across the device.

In an alternate embodiment of the present invention, the fusable pellet is housed within a contact element having two opposed tabs engaging a conductor. Upon collapse of the pellet, axial support for the contact is removed and the contact is urged upwardly by a compression spring deforming the tabs around and out of contact with the conductor.

8 Claims, 9 Drawing Figures

NONRESETTABLE THERMALLY ACTUATED SWITCH

This invention relates to a thermally actuated switch and more particularly relates to a "one shot" thermal limiter.

Thermal limiters are switches used to protect various electrical devices such as motors and transformers from operating at ambient temperatures which are in excess of prescribed safe levels. Thermal limiters may be used as cut-off devices in connection with other overload protection devices such as thermostatic switches. For example, a limiter may be connected to the windings of a motor of a device such as a hair dryer which draws high current, to protect the motor by cutting off power when the ambient temperature to which the switch is exposed exceeds the pre-determined level which could result in damage to the motor. One shot thermal limiters are non-resettable and when a switch of this type "blows" or opens, it must be replaced.

Thermal switches of this type are known in the art. The switch shown in U.S. Pat. No. 3,180,958 to Merrill is representative of the construction of this type of device. In that patent, a temperature-responsive switch is provided having housing or casing closed by a ceramic end-plug sealed by an epoxy material. Conductors project from opposite ends of the casing and the casing houses a pellet which is adapted to melt at a pre-determined temperature. Under normal operating temperatures, the solid pellet along with a spring holds the contacts together forming a closed circuit. When a fault temperature is reached, the pellet melts and allows the spring to move the contact and opens the circuit.

In the normal current carrying position, the thermal limiter typified by the construction shown in the Merrill patent establishes a circuit through one of the projecting conductors, the tubular casing, the conductive disc having peripheral edges engaging the interior of the casing and through the oppositely projecting conductor. A problem arises if the conductive disc member is not maintained in good physical contact with the interior of the casing as current capacity of the unit can be adversely affected and arcing can also occur.

Accordingly, it is the object of the present invention to provide an improved thermal limiter which effects an interruption of electrical circuit upon limiter being subjected to fault temperature and which during the normal operation establishes a positive electrical circuit. The thermal limiter of the present invention has a minimum number of parts and is convenient and inexpensive to manufacture and reliable in operation.

Briefly, according to the present invention, a thermal limiter is provided which includes a housing or casing of an electrically conductive material having a conductor axially projecting from one end of the casing. The opposite end of the casing is closed by a non-conductive plug and a second conductor extends through the non-conductive plug to the interior of the casing. In the closed position, a contact engages a portion of the second conductor within the casing and a trip spring extends between the contact and the non-conductive plug. The contact has a peripheral lip or edge which also engages the interior of the casing. Resilient biasing means, which may be in the form of an elastomeric member such as a rubber or silicone ball or cylinder, cooperate with the contact to apply a radial biasing force to urge the lip of the contact into engagement with the interior casing wall. A meltable or fusable pellet extends between the elastomeric member and the casing to cause the elastomeric member to deform forcing the contact into tight engagement with the casing side walls and compressing the trip spring. When the fusable pellet melts upon reaching the fault temperature, force is released from the elastomeric member allowing the elastomeric member to return to a non-deformed condition and permitting the contact to be moved away from the second conductor under influence of the trip spring to interrupt electrical conductivity.

In another embodiment of the present invention, the fusable pellet is contained within the contact and the contact is bifurcated to collapse around the second conductor to a non-conductive position when fault temperature is reached.

The above and other objects and advantages of the present invention will become more readily apparent from the following description, claims and drawings in which:

Figure 1:
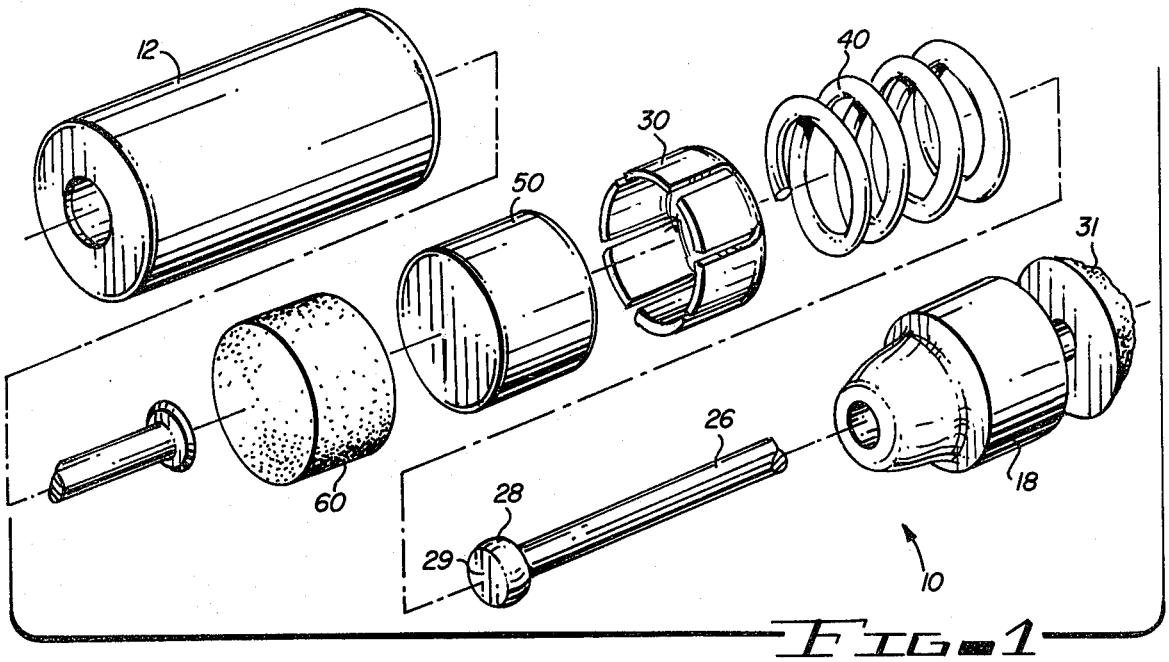
FIG. 1 is an exploded perspective view of a preferred form of the thermal limiter of the present invention.

Referring now to the drawings and more particularly FIGS. 1 to 5, a non-resettable or "one shot" thermal limiter switch is shown and is generally designated by the numeral 10 and includes a generally cylindrical casing 12 having interior wall 14. Casing 12 is formed from a suitable conductive material such as copper, brass or silver plated copper or brass. One end of the casing is formed having an integral closure 15 with a lead or conductor 16 extending axially from the closure 15.

The opposite end of the casing 12 receives non-conductive plug 18 which is inserted in the end of the casing and held in place at shoulder 19 by inwardly crimping the casing end walls 20. Plug 18 may be ceramic or a suitable high temperature plastic such as the material sold under the tradename "Ryton." Non-conductive plug 18 is provided with an axial bore 22 and the inner end of plug 18 is formed having an inwardly depending projection 24. A second electrical lead 26 extends through axial bore 22 terminating at an enlarged head 28 having a general surface 29 which may be flat or domed. Lead 26, due to its configuration, may be termed a "pinhead" lead. A sealing compound 31 may be applied at the upper end of plug 18 surrounding the extending lead or conductor 26.

Figure 5:
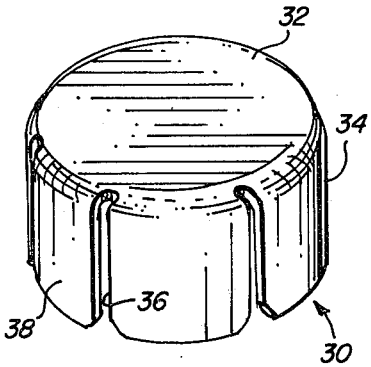
FIG. 5 is a perspective view of the contact element.
Figure 6:
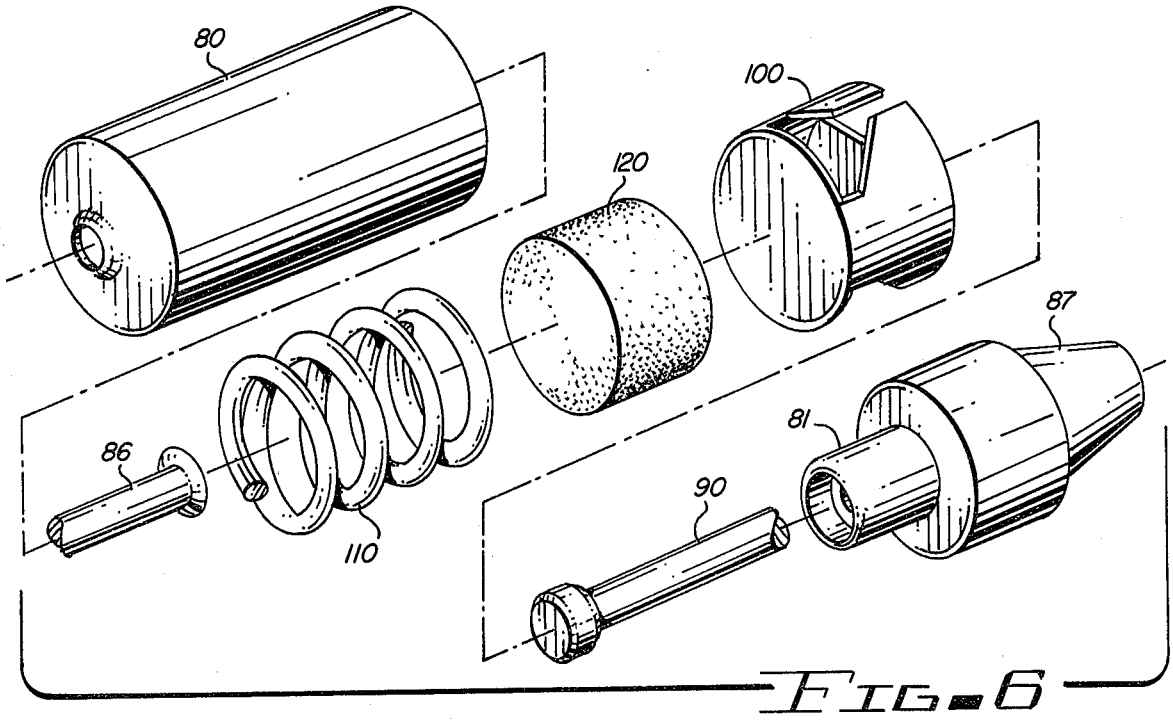
FIG. 6 is an exploded perspective view if an alternate embodiment of the present invention.

Conductive contact member 30, as best illustrated in FIG. 5, is disposed inside the casing 12 having a generally circular disc portion 32 extending transversely within the casing with an annular flange portion 34 extending peripherally at the disc 32. The flange portion 34 defines a plurality of spaced-apart axially extending slots 36 forming a number of individual contact tabs 38. The upper ends of the slots 36 terminate at enlarged openings 39 to facilitate flow of the soft pellet material past the contact when fault temperature is reached. Tabs 38 are radially deflectable and in the closed position are in engagement with the internal peripheral surface 14 of the casing to provide electrical contact between the casing and the contact 30. Contact 30 may be made of any suitable conductive material such as copper or brass or, in order to allow for higher current ratings, the contact may be silver plated brass or copper.

Figure 2:
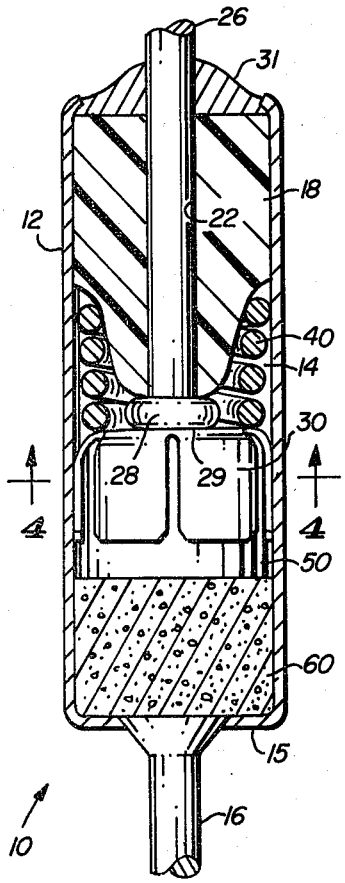
FIG. 2 is a longitudinal sectional view showing the limiter in a closed condition.

A compression spring 40 extends between the projection 24 of plug 18 and the upper surface of disc 32. Compression spring 40, in the closed position as seen in FIG. 2, applies a downward biasing force on the contact member 30 and is generally referred to as a "trip" spring. Spring 40 is adapted to expand upon collapse or melt of the pellet 60 to move the contact member 30 out of electrical contact with the contact head 29 so the electrical circuit between the conductors 26 and 16 is interrupted.

Figure 3:
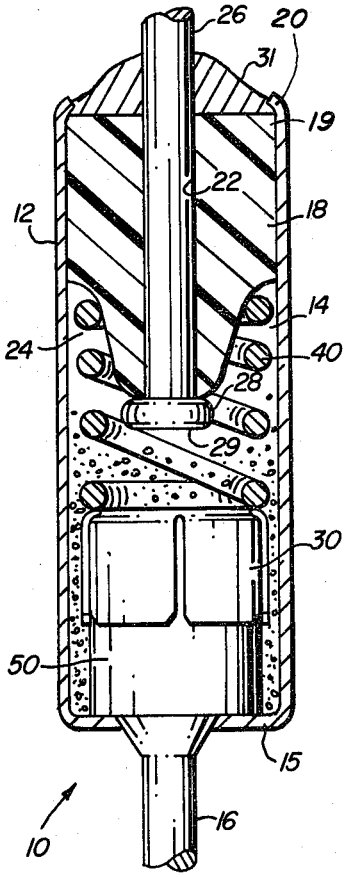
FIG. 3 is a longitudinal sectional view showing the limiter in a "blown" or open circuit condition.
Figure 4:
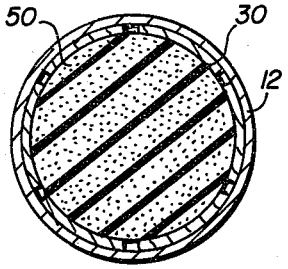
FIG. 4 is a sectional view taken along lines 4—4 of FIG. 2.

A resilient member 50 engages the underside of contact 32 within the area defined by the annular flange 34. Preferably resilient member 50 is a deformable elastomeric material such as a rubber or silicon ball or cylindrical member which under stress will deform to engage the inner sides of the tabs 38 applying an outward or radial force to the tabs 38 urging the tabs into mechanical electrical contact with the interior casing wall 14. The elastomeric member applies sufficient radial force to provide tight mechanical engagement between the tabs 38 and the casing interior to give good current carrying capacity. Member 50 also applies some axial force to maintain good contact at conductor head 29. The terms "resilient" or "elastomeric" member are used herein to describe a member having characteristics such that the member is capable of sustaining stress or force without permanent deformation. Note that in the non-stressed condition, the elastomeric member will return to the shape as shown in FIG. 3 having a major diametral dimension less than the diameter of the interior of annular flange 38. This permits the tabs 38, when the fault temperature is reached, to be moved along the interior wall of the casing out of electrical contact with the conductor head 29. Elastomeric member 50 has "memory" so that when the deformation force is removed the elastomeric member will return to a non-deformed condition with a major diametral dimension less than the diameter of the casing interior.

Thermally responsive pellet 60 is disposed within the casing between the lower end wall 14 and the elastomeric member 50. In the closed circuit condition as shown in FIG. 1, the compression spring 40 and the elastomeric member 50 are both compressed because of the volume of the casing interior occupied by the solid pellet 60. Pellet 60, as well-known in the art, is fusable or meltable when heated to a certain pre-determined temperature. Pellet 60 can be of various composition as known in the art such as the type of pellet described in the above-mentioned Merrill patent or of the type of material as described in U.S. Pat. No. 4,001,754 issued to E. Plasko. As long as the thermal limiter is not subjected to a temperature above the fault temperature, the pellet remains in a generally solid condition. When temperatures above the fault temperature are reached, the pellet collapses and the material of the pellet becomes fluid and flows around the elastomeric member 50 and the contact 30 allowing the spring 40 to expand. The slots 36 and openings 39 in the contact allow the fluid pellet material to flow upwardly within the casing. The elastomeric member 50 returns to the normal non-deformed condition as shown in FIG. 3. The removal of radial forces on the inner sides of tabs 38 permits the contact to be urged downwardly by the trip spring 40 so that electrical contact is broken.

In use, leads 26 and 16 are connected in an electrical circuit. Thermal limiter 10 is provided in the normally closed position as shown in FIG. 2. As long as the device is subjected to temperature below the fault temperature, the pellet 60 remains in a generally solid condition. However, when environmental or ambient temperature heats the casing adjacent pellet substantially to the fault or collapse temperature, the pellet collapses and becomes fluid moving or flowing past the disc and the contact. As described above, this relieves the radial pressure on the contact tabs 38 and also allows spring 40 to urge the contact 30 downwardly breaking the electrical circuit as the disc 32 is moved out of contact with the conductor head 28 and the interior casing wall 14.

Accordingly, it can be seen that the embodiment of the invention described above, provides significant advantages over the prior art. The inclusion of the deformable or elastomeric member 50 insures good electrical contact as the tabs 38 of the contact element 30 are radially urged into tight contact with the casing wall 14 and the disc 32 is held against the contact head 29.

FIG. 10 illustrates another form of the elastomeric member generally indicated by the numeral 150. Member 150 may be substituted in the construction shown in FIGS. 1 to 5 for member 50. Elastomeric member 150 is a generally cylindrical having a plurality of longitudinally extending ribs 152. The ribbed construction provides several advantages in that a flow path for the fluid pellet material around the elastomeric member is established. Ribs 152 also provide a more immediate and controlled deformation response when axial force or stress is applied so that the contact force at the casing wall and the conductor head can be controlled with better precision. In other respects, member 150 is generally as has been described above.

An alternate embodiment of the present invention is shown in FIGS. 6 to 9. In this embodiment, the thermal limiter is generally designated by the numeral 80 and again includes a generally cylindrical conductive casing member 82 having closed end 84 with axially projecting contact lead 86 extending from the end 84. The upper end of casing 82 is closed by a bead 87 which is of a suitable non-conductive material such as a ceramic or high temperature molded plastic having inward projection 81. Electrical conductor 90 extends through the bore 92 in bead 87. Conductor 90 terminates at an enlarged head 92 within the interior 96 of the casing 80.

Figure 7:
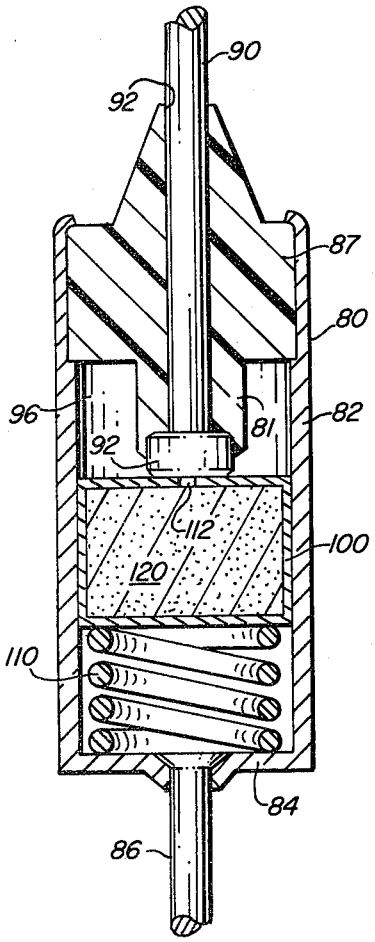
FIG. 7 is a longitudinal sectional view showing the embodiment of FIG. 6 in a closed position.

In closed position, as best shown in FIG. 7, electrical contact member 100 engages the head 92 of conductor 90 and is disposed in sliding engagement with the internal peripheral surface of the casing 82 to provide electrical contact between the casing and the contact. It will be obvious that this arrangement establishes an electrical circuit from conductor 86 through casing 82, contact 100 and lead or conductor 90. A compression spring 110 is interposed between the bottom of contact 100 and end wall 84 of the casing to urge the contact into engagement with conductor head 92.

Figure 8:
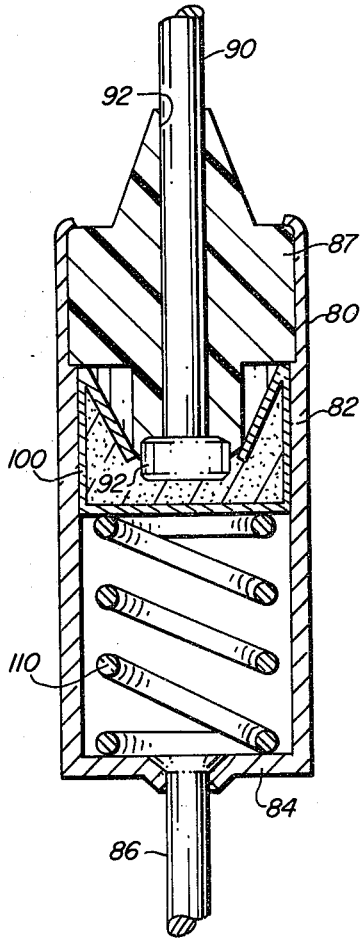
FIG. 8 is a longitudinal sectional view showing the thermal limiter of FIG. 6 in an open condition.
Figure 9:
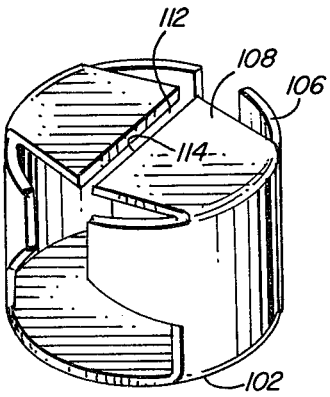
FIG. 9 is a perspective view of the contact element of FIGS. 6 and 8.

The construction of the contact 100 is best seen in FIG. 9. Contact 100 is formed of a suitable conductive material such as a soft copper, brass or as mentioned above, may be silver plated for higher current capacity. Contact has a base 102 which is preferably generally cylindrical having a diameter slightly less than the interior diameter of the casing. Side members 106 are arcuate and extend upwardly from the opposite edges of base 102 and are adapted to engage the interior casing walls. Tabs 108 secured to the upper edge of sides 106 and extend inwardly terminating at edges 114. As best seen in FIGS. 7 and 8, the tabs 108 project transversely within the casing interior into engagement with head 92 of conductor 90 in the closed position. A slight gap 112 separates the opposite edges 114 of tabs 108. In the closed position, the contact 100 is maintained in the position described above by pellet 120 which contained within the contact 100. A bearing disc not shown of non-conductive material may be interposed between the tabs 108 and the pellet 120. As has been described above with reference to previous figures, the composition of the pellet is well-known in the art and as long as the thermal limiter remains at a temperature below the collapse or fault temperature of the pellet, the pellet remains in a substantially solid condition.

When a temperature above the fault temperature is reached, the pellet becomes fluid and will flow from the interior of the contact 100 allowing the compression spring 110 to force the contact upwardly. The upward movement of contact 100 against the axial projection 81 of plug 86 will cause the opposite tabs 108 to be deflected downwardly as best shown in FIG. 8. When the contact is moved to the position shown in FIG. 8, the contact tabs 108 are no longer in engagement with the head 92 of contact 90 but are now in engagement with the non-conductive projection 81 of closure 87. This breaks the electrical circuit established between the conductors 86 and 90 to terminate any flow of current across the unit.

Accordingly, it will be apparent that the present invention provides an improved construction for a thermal limiting device. The embodiment of FIGS. 1 to 5 provides high reliability of electrical contact as the contact element is radially biased or urged into engagement with the walls of the casing providing substantial contact area. This construction avoids the use of opposing springs and inclusion of other parts which detract from the reliability of such devices. The embodiment shown in FIGS. 6 to 9 similarly provide substantial contact area at the casing walls allowing high current capacity for the unit. The collapse of the contact upon reaching a fault temperature provides a positive action terminating current flow through the unit.

It will be obvious to those skilled in the art to make various changes, alterations and modifications to the embodiments described herein. To the extent that these changes, alterations and modifications do not depart from the spirit and scope of the appended claims, they are intended to be encompassed therein.

I claim:

1. A thermal limiter comprising:

(a) an electrically conductive casing having a wall defining a generally cylindrical interior;

(b) a first electrical conductor secured to said casing and being electrically conductive therewith;

(c) a second conductor extending into said casing interior having contact head therein, said second conductor being electrically insulated from said casing;

(d) contact means engaging said conductive head in a closed position, said contact means having flange means radially deflectable into engagement with said casing interior;

(e) a fusable pellet in said casing adapted to become fluid at a pre-determined temperature;

(f) elastomeric means interposed between said pellet and said contact means deformable to urge said contact flange means radially into contact with said casing interior when an axial force is applied to said elastomeric means and adapted to return to a non-deformed condition when said axial force is removed thereby removing said radial force from said contact flange means; and (g) spring means extending between said contact means and said casing whereby reaching fault temperature, said pellet becomes fluid permitting said elastomeric means to return to said non-deformed position thereby allowing said spring means to urge said contact away from the conductor head breading said electrical conductivity between said first and second leads.

2. The thermal limiter of claim 1 wherein said deformable means comprises a rubber member.

3. The thermal limiter of claim 2 wherein said elastomeric member is generally spherical shaped.

4. The thermal limiter of claim 2 wherein said elastomeric member is generally cylindrical shaped.

5. The thermal limiter of claim 4 wherein said cylindrical elastomeric member is provided with a plurality of longitudinally extending ribs.

6. The thermal limiter of claim 1 wherein said contact comprises generally circular disc member having axially extending peripherally arranged tabs.

7. A thermal limiter comprising:

(a) a casing defining a generally cylindrical interior;

(b) a first lead secured to said casing being electrically conductive therewith;

(c) a second conductor having a head within said casing interior, said second conductor lead being electrically insulated from said casing;

(d) spring biasing means within said casing interior;

(e) contact means interposed between said spring biasing means and engaging the contact head of said first conductor means in a closed position, said contact means including a base, opposite side wall member and an upper side including at least one generally transverse tab member contacting said head in the closed position; and (f) fusable pellet means extending axially between said tab member and the base of said contact in said closed position whereby when a predetermined temperature is reached, said pellet is allowed to flow axially moving said contact means toward said contact head and causing said tab member to be deflected moving said tabs out of conductive engagement with said conductor head.

8. The thermal limiter of claim 7 further including load bearing means interposed between said pellet and said contact tabs.

* * * * *